US006724411B2

(12) United States Patent
Reele

(10) Patent No.: US 6,724,411 B2
(45) Date of Patent: Apr. 20, 2004

(54) THERMAL PRINTER WITH BI-DIRECTIONAL PRINT HEAD MOVEMENT AND METHOD THEREOF

(75) Inventor: Samuel Reele, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 334 days.

(21) Appl. No.: 09/766,077

(22) Filed: Jan. 19, 2001

(65) Prior Publication Data

US 2001/0012044 A1 Aug. 9, 2001

Related U.S. Application Data

(63) Continuation of application No. 09/314,387, filed on May 19, 1999, now abandoned.

(51) Int. Cl.[7] ..... B41J 11/00; B41J 2/325

(52) U.S. Cl. ..... 347/174; 347/176

(58) Field of Search ..... 347/174, 173, 347/171, 172, 175–176; 400/120.02, 120.03, 120.04, 120.01; 358/503

(56) References Cited

U.S. PATENT DOCUMENTS 4,250,511 A * 2/1981 Stein et al. ..... 347/176
5,157,413 A * 10/1992 Nagato et al. ..... 347/199
6,064,414 A * 5/2000 Kobayashi et al. ..... 347/172
6,104,421 A * 8/2000 Iga et al. ..... 347/173
6,118,467 A * 9/2000 Park ..... 347/176
6,132,115 A * 10/2000 Insley et al. ..... 400/56
6,402,402 B1 * 6/2002 Suzuki et al. ..... 400/120.02

FOREIGN PATENT DOCUMENTS

JP 361084262 A * 4/1986 ..... B41J/3/20
JP 361089058 A * 5/1986 ..... B41J/3/20

* cited by examiner

*Primary Examiner*—Lamson Nguyen
*Assistant Examiner*—K. Feggins
(74) *Attorney, Agent, or Firm*—Walter S. Stevens; Norman Rushefsky

(57) ABSTRACT

A printer and method of generating hard copy comprising only one ejection step from either a thermal printing mechanism using one print head or a thermal printing mechanism using first and second thermal printing heads. The thermal printing mechanism with one printing head operates bilaterally. Alternatively, the thermal printing mechanism simultaneously operates dual thermal printing heads with only one ejection for release of a thermally sensitive hard copy output media.

7 Claims, 4 Drawing Sheets

THERMAL PRINTER WITH BI-DIRECTIONAL PRINT HEAD MOVEMENT AND METHOD THEREOF

This application is a continuation application of U.S. application Ser. No. 09/314,387, filed May 19, 1999 and now abandoned.

FIELD OF THE INVENTION

The present novel invention relates generally to a thermal printer adapted to more efficiently print a thermal hard copy output resulting in less time to produce a thermal print. More specifically, the present invention relates to a thermal printing mechanism and method of utilizing a bilateral single head printer or multiple heads for printing alternate or multiple rows simultaneously in multiple colors.

BACKGROUND OF THE INVENTION

Technology related to the novel invention is disclosed in Japan Patent No. 8,072,282 assigned to Fuji. Also, U.S. Pat. No. 5,367,321 assigned to Kyocera, discloses an electrical circuit system comparable to that used in the novel improved invention. The problem of improving print speed in related printers is addressed in both Japan Patent No. 6,127,267 assigned to Sharp and U.S. Pat. No. 4,774,529 assigned to Xerox. Of further background relevance are Japan Patent No. 7,214,870 assigned to Brother Kogyo; U.S. Pat. No. 5,196,864 assigned to Eastman Kodak; and, Japan Patent No. 7,184,410 assigned to Silver Seiko.

More relevant is Japan Patent No. 8,072,282 which discloses the use of three staggered print heads arranged linearly to improve print speed and Japan Patent No. 6,127,267 wherein two parallel electrodes provide simultaneous recording. Japan Patent No. 7,214,870 also discloses an arrangement wherein one or more print heads are arranged in parallel.

For additional background purposes, U.S. Pat. No. 5,367,321 issued to Shigenori, et al. discloses multiple insulating substrates to form a linear heating element in a thermal printer and U.S. Pat. No. 4,774,529 suggests a printing system for increasing the speed of a multi-color printer when utilized in a single color mode by repositioning the recording head cartridge from a first level to a second level to enable two lines of information to be created during a single scanning pass when it has been determined by the electronic means to be of the same color.

Other art appears in U.S. Pat. No. 5,196,864 wherein a multiple print head thermal printer is disclosed.

U.S. Pat. No. 4,946,297; U.S. Pat. No. 5,000,595; and, Japan Patent No. 7,184,410 refer to the use of four separate line print heads being mounted and teaches how to split a line into four prints using four separate print heads and then joining the line together.

Today's thermal printers are designed with one thermal head and multiple donor media types. Typically, the donor media is composed of multiple areas of different donor material which are mechanically linked in a specific sequential order. Typically, three areas of color specific donor material are required for a photographic quality thermal hard copy print. For a typical donor today, that sequence of color specific donor material may be yellow, magenta, and cyan. Other donor materials may be composed of a base sequence of four color specific donor areas: yellow, magenta, cyan, and black. The particular sequence of donor material (whatever that may be) is repeated in a serial fashion to complete a roll of donor material.

Referring to prior art, FIG. 1, in producing a thermal hard copy output, donor material (usually the least thermally active color, yellow 15) is positioned over the thermal paper 13. Mechanical rollers 16 and 17, edge and color sensors are used to recognize and position the desired donor material color over the thermal output paper. A thermal head 11, in which pixels 12 (typically 300 per inch) are arranged in a linear fashion, is positioned at the edge of the thermal paper. Digitized control data is then applied to each pixel simultaneously (usually pulse modulated) such that a row or line of one color is printed onto the thermal paper. Through stepper motors and mechanics, and control logic, for example, such as disclosed by the electrical circuit system in Kyocera which is adopted and incorporated herein by reference, either the thermal print head or thermal output paper is advanced one line or row and the thermal transfer process is repeated for that row. This whole sequence is repeated until one color is thermally transferred onto one full sheet of desired thermal output paper. The thermal paper is projected, as shown in prior art FIG. 1*b,* donor material is advanced to the next color area, and the thermal output paper is re-inserted, as shown in prior art FIG. 1*c.* The entire process is repeated until the next color (for example, magenta 18) in the sequence is transferred onto the thermal output paper. This process is repeated again with donor material advancing to the next color area until all colors of the donor material are transferred or thermally printed onto the thermal output paper. The problem with this process is that it requires a relatively lengthy time period to complete. More particularly, it is time-consuming, mechanically intensive and requires four paper projections for a donor composed of four independent color areas per each thermal print.

The novel invention resolves the problem of lengthy time consumption and four paper projections for a donor composed of three independent color areas for each thermal print. Specifically, the novel invention significantly reduces the required projections and mechanical steps, and thereby the printing time necessary for a thermal printer to produce a thermal print.

SUMMARY OF THE INVENTION

An object of this invention is to provide a novel combination of steps in a thermal printer printing process wherein the output paper is retained and thermal printing occurs in a bilateral direction instead of a unilateral direction and wherein the output paper is ejected after the application of each color.

This object is achieved by a novel integration of a preferred embodiment thermal printer mechanism having a donor media which contains a yellow media section, a magenta media section, a cyan media section, and a black media section, all of which are positioned mechanically between the thermal print head and the thermal output media by the rotation of two roller spools. In addition, the thermal print head contains a mounting mechanism that works like a universal socket wherein the thermal head is precisely positioned over the donor media at the correct angle when the head is traveling in a left to right motion as well as a right to left motion. The stepper motor control is adapted to direct a bi-directional stepper motor and comprises the electronics therefor.

One of the most outstanding advantages of the present invention is that the use of the above described mechanical and electrical combination significantly increases the printing speed of thermal head printers approximately 30% or more.

DETAILED DESCRIPTION OF THE INVENTION

Figure 1A:
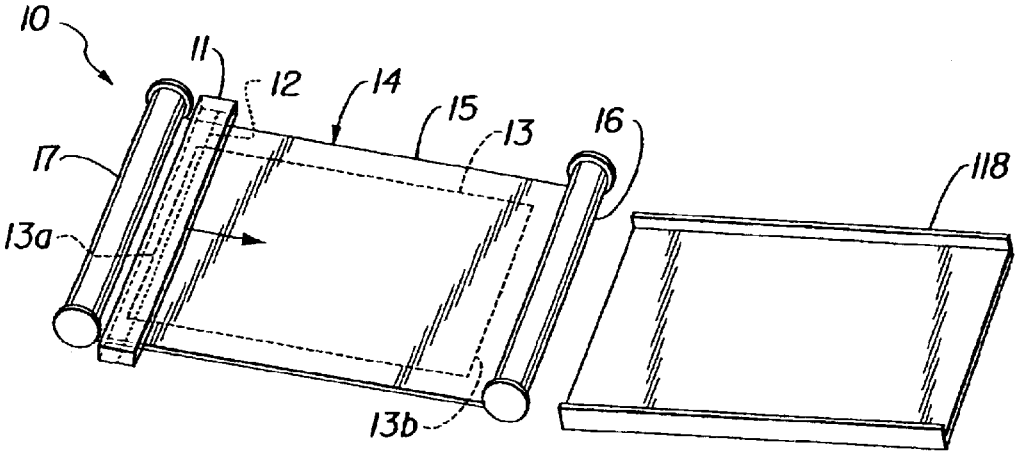
FIG. 1a (PRIOR ART)
FIG. 1*a* is a perspective view of a first aspect of an internal printing mechanism in a prior art printer.

In FIG. 1*a* there is shown a printer mechanism 10 of a prior art printer and an illustration of the prior art method of operation. As further shown in greater detail in FIGS. 1*a,* 1*b,* and 1*c,* these prior art thermal printers were designed to produce hard copy output 13 starting at a leading edge 13*a* and printing to a trailing edge 13*b* with one thermal head 11, thermal heating elements (or pixels) 12, and multiple donor media 14.

Figure 1B:
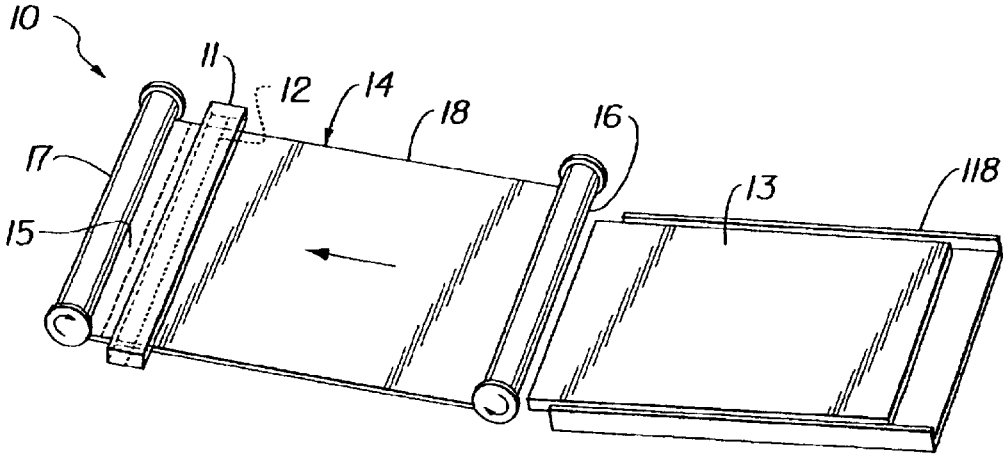
FIG. 1b (PRIOR ART)
FIG. 1*b* is a perspective view of a second aspect of the internal printing mechanism in the prior art printer.

Typically the donor media 14 of the prior art as illustrated in FIGS. 1*a,* 1*b,* and 1*c* are composed of multiple areas of the donor media 14 which are mechanically linked in a specific sequential order. There is shown a yellow donor media 15 located in between a first donor media spool 16 and a second donor media spool 17. There also is a magenta donor media 18. As illustrated in FIGS. 1*a* and 1*b,* in the prior art at least two areas of color specific donor media 14 are required for a photographic quality thermal hard copy print. For typical donor media 14 today, that sequence of color specific donor material is yellow, magenta, and cyan. Other donor materials may be composed of a base sequence of four color specific donor areas: yellow, magenta, cyan, and black. The particular sequence of donor material (whatever that may be) is repeated in a serial fashion to make up a complete roll or spool of donor material.

Figure 1C:
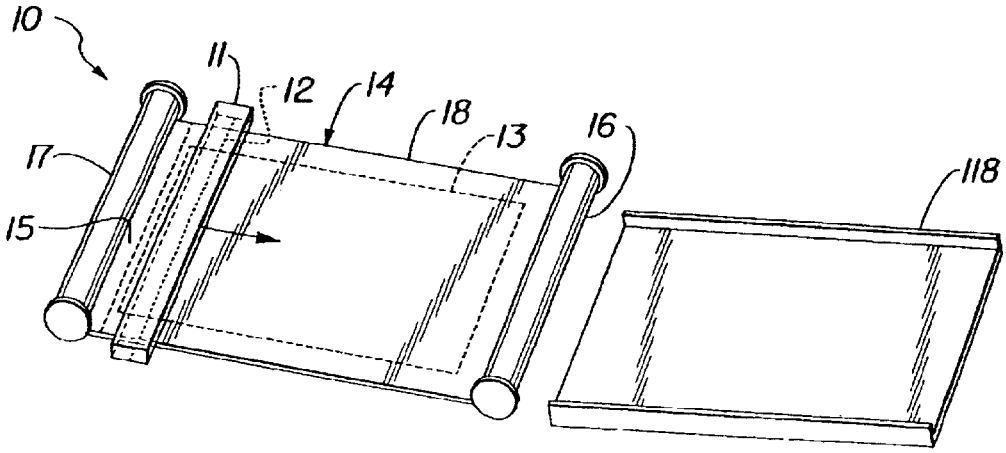
FIG. 1c (PRIOR ART)
FIG. 1*c* is a perspective view of a third aspect of the printing mechanism in the prior art printer.

In producing the thermal hard copy output 13 , donor material (usually the least thermally active color) is first positioned over the hard copy output 13, e.g. thermal paper. Mechanical rollers, edge and color sensors are used to recognize and position the desired donor material color over the thermal output paper. A thermal head, in which pixels (typically 300 per inch) are arranged in a linear fashion, is positioned at the edge of the thermal paper. Digitized control data is then applied to each pixel simultaneously (usually pulse modulated) such that a row or line of one color is printed onto the thermal paper. Using stepper motors and mechanics, and control logic well known in the art, either the thermal print head 11 or the hard copy output 13 or thermal paper is advanced one line or row and then the thermal transfer process is repeated for that line or row. This whole well known sequence is repeated until one color is thermally transferred onto one full sheet of desired hard copy output 13. The thermal paper is projected, donor material is advanced to the next color area, magenta 18, as shown in FIG. 1*b*. The hard copy output 13 or thermal output paper as shown in FIG. 1*b* is re-inserted and the magenta color is printed as shown in FIG. 1*c*. The entire process is repeated until the next color in the sequence is transferred onto the thermal output paper. As shown in FIGS. 1*b* and 1*c,* this well known prior art process is repeated again with donor material advancing to the next color area of a plurality of color areas issuing from the first donor media spool 16 to the second donor media spool until all colors of the donor media 14 are transferred or thermally printed onto the hard copy output 13 or thermal output paper.

Figure 2A:
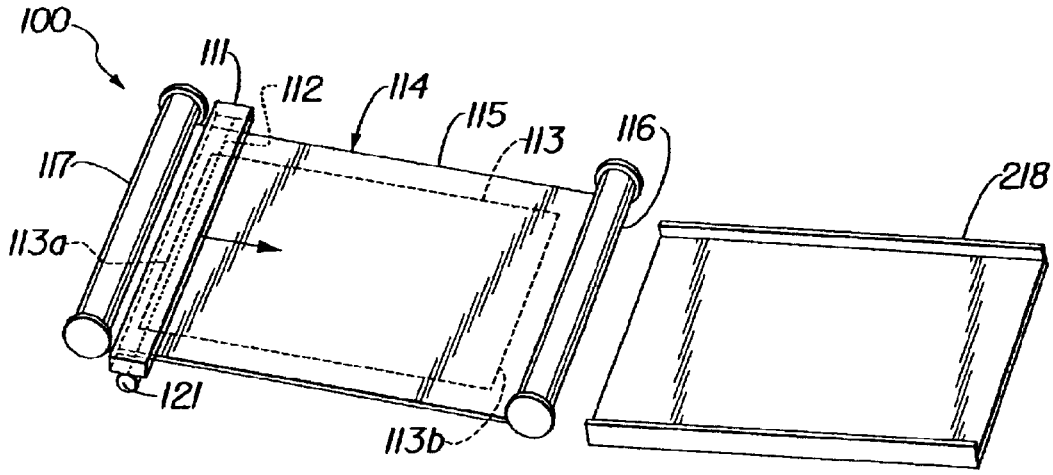
FIG. 2*a* is a perspective view of a first aspect of an internal printing mechanism which depicts a first preferred embodiment of a printing mechanism of the novel invention.

The above described prior art process as generally illustrated in FIGS. 1*a,* 1*b,* and 1*c* is characterized by engineers in the art as mechanically intensive because this prior art process requires no less than four (4) paper projections for a donor composed of a like number or three (3) independent color areas for each full color thermal print (typically a clear coat is printed over all colors). The resulting prior art process, as briefly shown in FIGS. 1*a,* 1*b,* and 1*c,* is a thermal process requiring an extended period of time, To. The novel invention as illustrated in FIGS. 2*a,* 2*b,* 2*c,* 2*d,* 2*e,* 2*f* and FIGS. 3 and 4 significantly reduces the processing time $T_0$ by approximately 20% to 50% to a new processing time $T_N$. Thereby, with the novel arrangement of donor elements and printing heads illustrated in FIGS. 2*a* through 4, printing time for a thermal printer is significantly and substantially reduced such that $T_0-(0.20)T_0=T_N$.

Referring again to FIG. 1*a,* a detailed description of the prior art printing process is as follows. The prior art printing mechanism 10 contains a thermal head 11 which contains thermal heating pixels. There are 300–440 elements 12 or pixels per inch in density, for example. The mechanism 10 also contains a thermally active donor material 14 which is mechanically positioned between the thermal head 11 and the hard copy output media 13, for example thermal paper. A specific color from the donor material 14 is provided by advancing (virgin) donor material 14 of various colors such as yellow 15 via two spools 16 and 17, respectively. When completed, the hard copy output media 13 or thermal paper is ejected from the printing mechanism 10 housed internally in a printer housing (not shown for clarity) and positioned onto a customer retrieval shelf 118.

As previously described, the prior art sequence and method of printing is depicted in FIGS. 1*a,* 1*b,* and 1*c*. Specifically, in FIG. 1*a,* the thermal head 11 commences a first step of printing by transferring yellow donor media 15 at the leading edge 13*a* opposite from the trailing edge 13*b* associated with the hard copy output 13. Via a single linear array of the individual elements 12, pulse width modulation commands, the thermally active donor material 14 is preferentially heated on a pixel by pixel basis for the entire line or row. Typically, the head 11 moves in a left to right motion or from the leading edge 13*a* to the trailing edge 13*b* of the thermal paper in a controlled fashion, transferring electronically selected colors from the donor material 14 from a raster or bit map function for the next line or row of the hard copy output 13. In the first step of this sequence all the appropriate yellow thermal media 15 is transferred to the entire area of the thermal hard copy output 13.

Shown in FIG. 1*b*, the thermal output 13 is temporarily ejected to the customer retrieval shelf 118. While this ejection step occurs, in a second step the thermal head 11 is repositioned to a position where the leading edge 13*a* of the thermal hard copy output media 13 was initially located.

As shown in FIG. 1*c*, the (virgin) donor media 14 is advanced by the step of simultaneously rotating the spools 16 and 17 in a like direction, respectively, such that the next color to be printed, for example donor media magenta 18, is in a position between the thermal head 11 and the thermal output 13.

It should be noted that notwithstanding whether the exact sequence of the above described prior art steps is utilized, the inventor has discovered that a common element in the prior art sequencing is that the thermal output paper or more specifically the thermal output 13 is always ejected at an intermediate step in the sequencing of the prior art printing process as illustrated in FIGS. 1*a,* 1*b,* and 1*c.*

In addition, the improvement represented in the novel invention is based partly on recognition of a unique attribute of the prior art, namely, that prior art thermal printing occurs in a unilateral direction. See, for example, FIGS. 1*a,* 1*b* and 1*c.* First, there is shown the yellow donor media 15. It is printed from left to right. Next, the paper is ejected, the thermal head 11 is moved in the z direction, the donor media is advanced to magenta 18, the thermal head 11 is lowered, and finally, the magenta 18 is printed from left to right where required by raster or bit mapping functions on a pixel by pixel or thermal element basis one row at a time until the entire output 13 has been thermally printed. In FIG. 1*b* the thermal output 13 is shown temporarily ejected and in FIG. 1*c* the color specific printing process repeats itself again.

A first preferred embodiment for the mechanism and steps of the novel invention are depicted in FIGS. 2*a* through 2*f.* There is shown an arrangement which utilizes a preferred embodiment thermal printing mechanism 100. The preferred embodiment thermal printing mechanism 100 contains a thermal head 111 with elements 112. It also contains a thermally sensitive output media 113 having a leading edge 113*a,* a trailing edge 113*b,* and a customer retrieval shelf 218. In addition, the preferred embodiment thermal printer mechanism contains donor media 114 which further contains a yellow media section 115 located between a first donor media spool 116 and a second donor media spool 117. There is also a magenta media section 181, a cyan media section 119, and a black media section 120. All of said media sections are adapted for positioning mechanically between the thermal print head 111 and the thermally sensitive output media 113 by the likewise rotation of the first donor media spool 116 and the second donor media spool 117. In addition, the thermal print head 111 contains a mounting mechanism, i.e., a universal stepping motor 121. With the universal stepping motor 121 connected to the thermal print head 111 it is precisely mechanically positioned over the donor media 114 at electronically pre-selected time intervals and at an electronically pre-selected angle as the print head 111 is traveling in a left to right direction and also when the thermal print head 111 is traveling intermittently in an opposite or right to left direction. Thus, a customary stepper motor control for the universal stepping motor 121 is altered and adapted using known and available mechanical means to operate the thermal print head 111 bi-directionally.

Figure 2B:
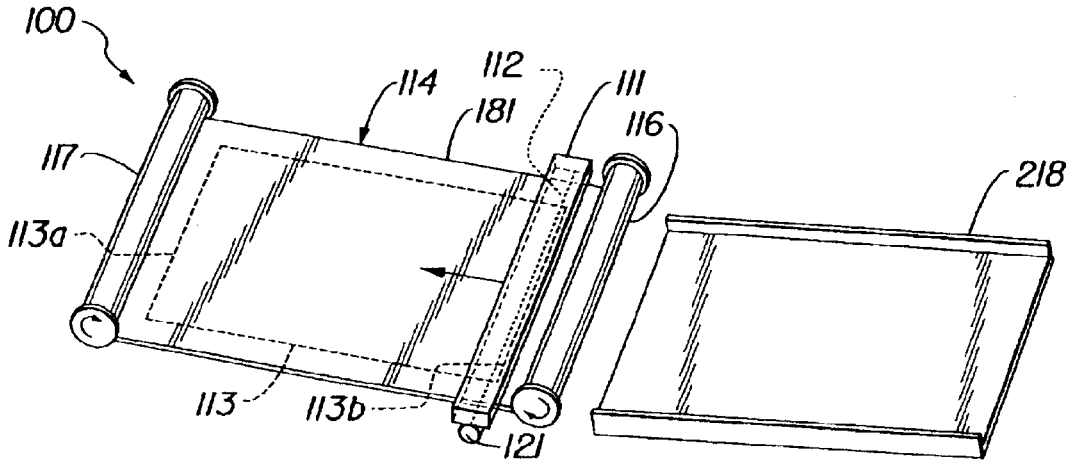
FIG. 2*b* is a perspective view of a second aspect of the internal printing mechanism which depicts the first preferred embodiment of the printing mechanism of the novel invention.
Figure 2C:
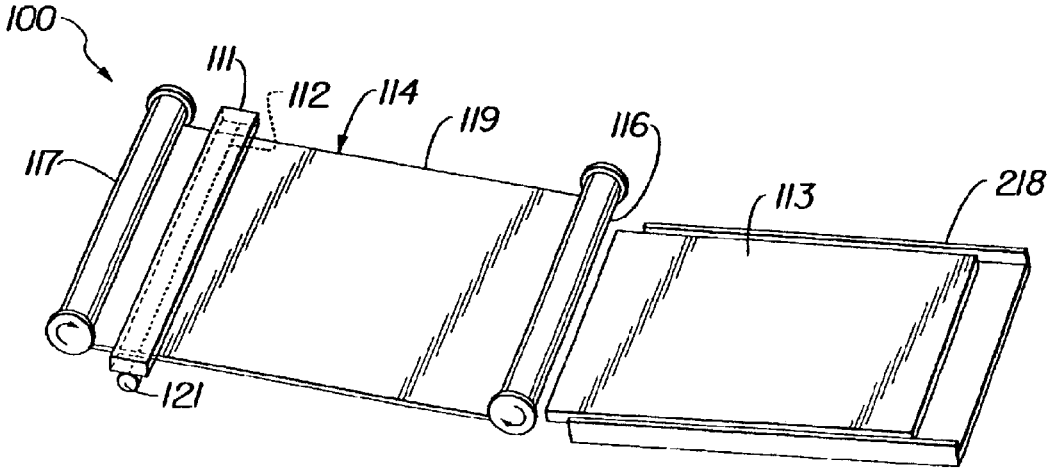
FIG. 2*c* is a perspective view of a third aspect of the internal printing mechanism which depicts a first preferred embodiment of the printing mechanism of the novel invention.
Figure 2D:
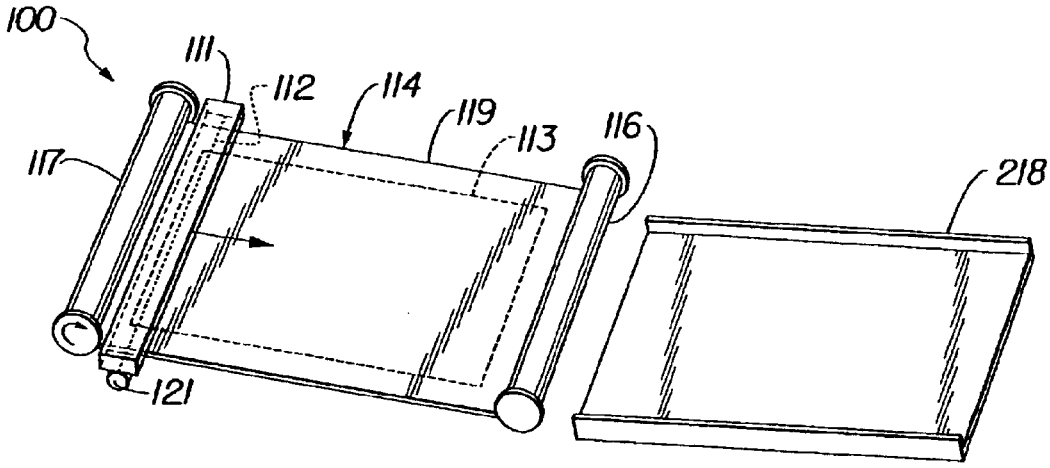
FIG. 2*d* is a perspective view of a fourth aspect of the internal printing mechanism which depicts the first preferred embodiment of the printing mechanism of the novel invention.

A novel sequence of operation for the preferred embodiment of thermal printer mechanism 100 is fully illustrated in FIGS. 2*a,* 2 *b,* 2*c,* 2*d,* 2*e,* and 2*f.* In FIG. 2*a,* the yellow media section 115 is positioned between the thermal head 111 and the output media 113 via the rotation of spools 116 and 117. The thermal head 111 is positioned intermittently at pre-selected heights and angles by the universal stepper motor 121. The novel mechanism and thermal printing process initially operates and progresses, respectively, as in the prior art initial sequencing up to the completion of printing all of the yellow color 115 to the thermal output paper edge 113*b.* In the novel printer mechanism 100 and in the method of its operation, instead of temporarily projecting the thermal output 113 onto the customer retrieval shelf 218 (as previously illustrated in FIG. 1*b*), the donor media 114 is advanced as shown in FIG. 2*b* until a magenta media section 181 is positioned over the thermal output media 113 via likewise rotation of the rollers 116 and 117 by employing the use of well known color donor sensors (not shown) and well-known motor control techniques. The thermal head 111 is temporarily moved away in a vertical or z-direction from the advancing donor medial 14 and then lowered prior to restarting the printing process for the next color media, for example, the cyan media section 119 as illustrated in FIG. 2*c.* The bi-directional universal stepper motor 121, repositions the thermal print head 111 at a pre-selected angle in preparation for the next step of reverse printing (right to left). There is shown in FIG. 2*b* the step wherein the thermal print head 111 actuates a line of thermal printing elements 112*a* at the trailing edge 113*b* and prints the magenta media section 181 sequentially towards the leading edge 113*a* and onto the thermal output media 113.

Figure 2E:
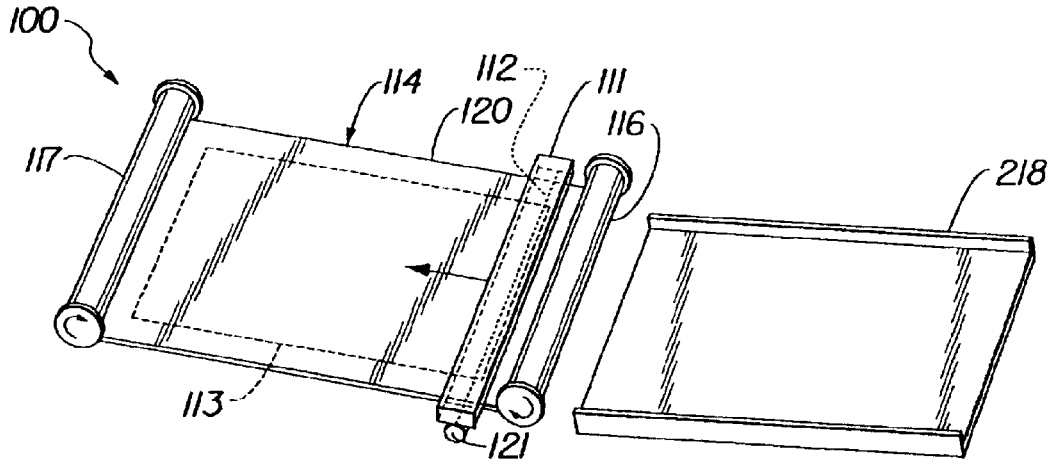
FIG. 2*e* is a perspective view of a fifth aspect of the internal printing mechanism which depicts the first preferred embodiment of the printing mechanism of the novel invention.
Figure 2F:
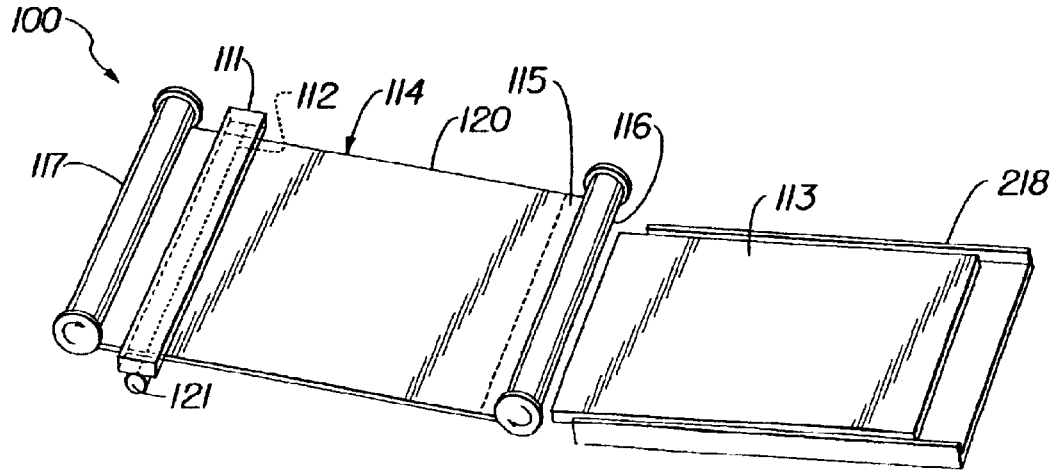
FIG. 2*f* is a perspective view of a sixth aspect of the internal printing mechanism which depicts the first preferred embodiment of the printing mechanism of the novel invention.

Referring to FIG. 2*c,* the thermal head 111 ends up at the left or leading edge 113*a* of the output media 113 after the step of printing the magenta media section 181. The next step is the macro process of printing the cyan media section 119 in a leading edge 113*a* to trailing edge 113*b* direction (left to right). In FIG. 2*e* is the step of printing the black media section 120 in a reverse right to left direction. This is similar to the previous description of the step of printing the yellow media section 115 and the magenta media section 181, respectively, as shown and described previously referencing FIGS. 2*a* and 2*b.* In the novel sequencing of steps using the preferred printing mechanism 100, the step of ejection of the thermal output media 113 as illustrated FIG. 2*f,* occurs only after completion of the steps of printing all colors or media sections.

A first temporary ejection (not illustrated) of the thermal output media 113 can electively occur after the first complete pass of the print head 111 from the leading edge 113*a* to the trailing edge 113*b* (left to right) for the color yellow 115. Referring now to FIG. 2*c,* on the next sequence of printing from the trailing edge 113*b* to leading edge 113*a* (right to left) another elective second temporary ejection of the thermal output media 113 may occur. In the novel structure and method of the invention, at least three temporary projections are eliminated using bi-directional or bilateral printing. The total printing time $T_0$ using prior art sequencing is significantly reduced to $T_N$ using the novel invention whereby $T_0 >> T_N$.

Figure 3:
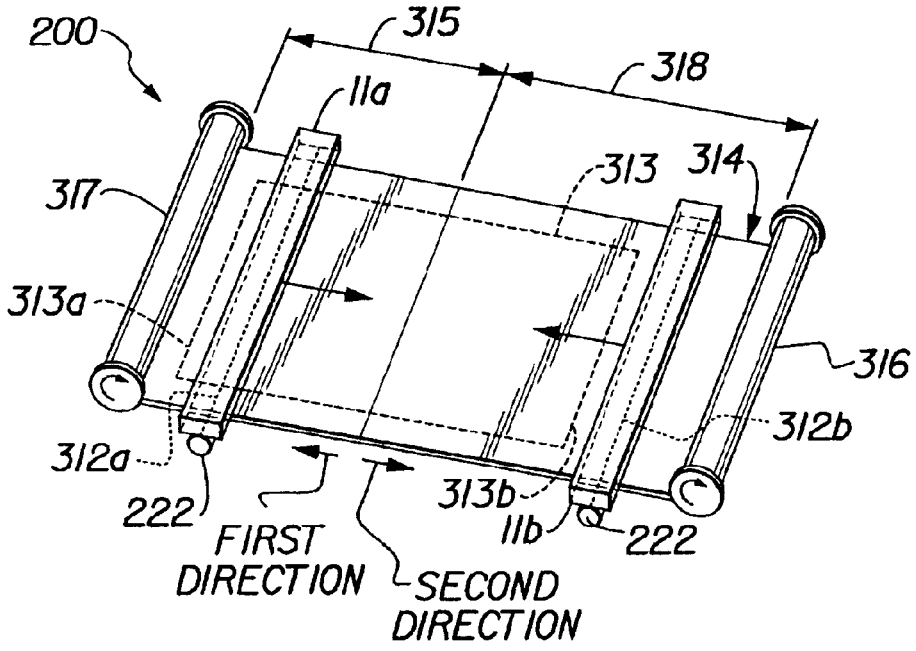
FIG. 3 depicts a first alternative embodiment wherein separate multiple thermal heads and a single donor media spool are utilized for printing; and, FIG. 4 depicts a second alternative embodiment wherein juxtaposed multiple thermal heads and multiple donor media spools are utilized for printing.

In FIG. 3, there is shown a first alternate or second preferred embodiment wherein a printing mechanism 200 utilizes two separate thermal heads 11*a* and 11*b*. Each is connected to a separate but equivalent universal stepping motor 222 adapted to operate bi-directionally. The print mechanism 200 uses a single donor media spool 316 and an uptake spool 317. The alternative embodiment is enabled by using the stepper motor 222 as a unidirectional stepper means to control the movement of both heads 11*a* and 11*b*. The heads 11*a* and 11*b* have a first heating element set 312*a* and a second heating element set 312*b,* respectively. Thus, the first alternative embodiment as shown in FIG. 3 is adapted with the additional steps of sequentially moving thermal output media 313 having a leading edge 313*a* and a trailing edge 313*b* in two directions: for example, first in a right to left direction, after which head 11*a* transfers yellow from a yellow media section 315 of a spooled donor media 314 in a left to right direction starting from the leading edge 313*a* of the thermal output media 313. After yellow has been completely transferred to the thermal output media 313 as previously described, the thermal output media 313 moves in a left to right direction and wherein after which the thermal output media 313 is positioned such that head 11*b* transfers magenta color from the magenta media section 318 of the thermal donor media 314. As a further alternative step, the spooled donor media 314 can be mechanically sequenced to move in a right and in a left direction to achieve a reduction in the overall size physical size of the spooled donor media 314 when the two heads 11*a* and 11*b* are both utilized to transfer color from the same sections of the spooled donor media 314.

The novel method is completed by repeating the above step as described for the color yellow such that in addition to sequential printing of the colors yellow and magenta, next the color cyan and then the color black is printed using the thermal elements 312*a* and 312*b,* respectively. Hence, the color cyan (not shown) is printed like the color yellow 315 and the color black (not shown) is printed like the color magenta 318. Only one output paper ejection step is utilized and required. A substantial time savings of at least 20% is realized due to having only one paper ejection step instead of three as required and utilized by prior art printers.

The novel arrangement of the printing mechanism 200 shown in FIG. 3 provides additional time savings by employing the two separate print heads 11*a* and 11*b* and by the repositioning thereof serially with like serially scheduled or programmed printing times. In the novel assembly and operation of the printing mechanism 200 the first thermal print head 11*a* is repositioned as the second thermal head 11*b* is printing and vice versa.

Figure 4:
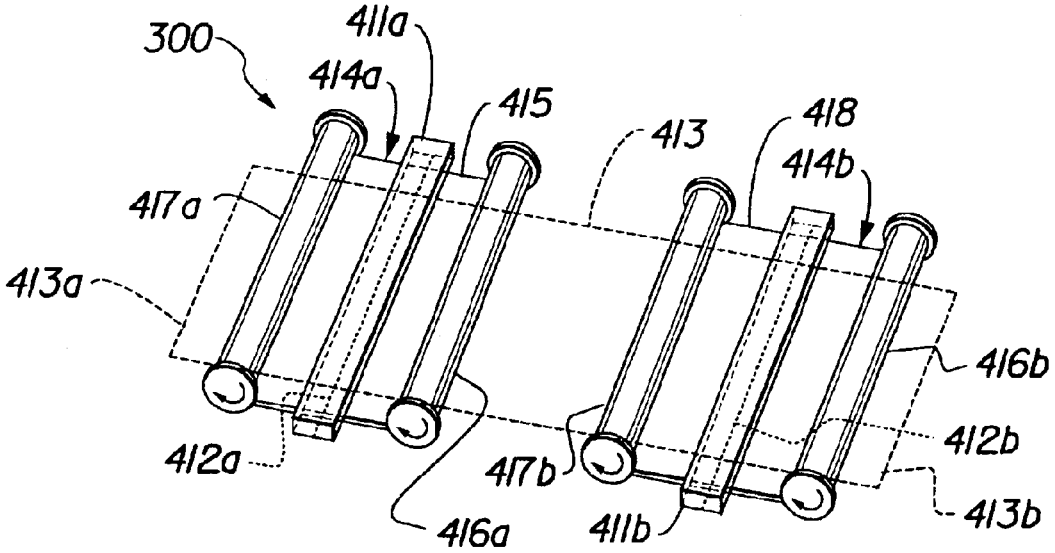

A third alternative preferred embodiment for the novel operating structure is shown in FIG. 4. This novel arrangement for a printing mechanism 300 provides at least two adjacent thermal heads 411*a* and 411*b* and at least two sets of related juxtaposed donor media spools 416*a,* 416*b,* and 417*a,* 471*b,* respectively. The printing mechanism 300 is made up of a combination of first and second thermal heads 411*a* and 411*b* and a spooled donor media 414*a* at the left of the hard copy output media 413 and a spooled donor media 414*b* at the right of the hard copy output media 413. The donor media 414*a* is mechanically and fixedly connected in-between a first donor media output spool 416*a* and a first donor media input spool 417*a*. The donor medium 414*b* is mechanically and fixedly connected in-between two roller mechanisms 416*b* and 417*b*. In this last described embodiment, it is significant to recognize that the printing mechanism 300 is merely a simple exemplary embodiment. This alternative novel embodiment can be expanded to include more than two sets of donor mediums in a donor mechanism and more than two donor mechanisms with a like increase in printing heads such as 411*a* and 411*b*. It should be noted that these two donor mechanisms 416*a* and 416*b* may easily number three, four, or more mechanisms or N mechanisms where N is an integer and $N \geqq 2$. This embodiment results in an overall improvement in printing time due to the parallel feature of printing with two heads which result in less additive donor spooling time, less additive time to move the thermal head in the z direction and the ability to print 1.5 colors for each complete pass of one of the two thermal heads.

In yet another alternate structure or fourth embodiment, the printing mechanism 300 is as shown in FIG. 4 and described above. With the two printing thermal heads 411*a* and 411*b* and two spools 416*a* and 416*b* of donor media, respectively, at least two colors can be simultaneously printed with simultaneously activated print heads. The novel invention is adapted to accomplish this operational level by employing known stepper motor control technology to simultaneously operate thermal heads 411*a* and 411*b* and/or, alternatively a stepper motor control for the two spools 416*a* and 416*b* of donor media. Basically, one head 411*a* thermally prints all pixels within a row 412*a* at the leading edge of the paper 413*a*. The other or second head 411*b* thermally prints all pixels within a row 412*b* at the trailing edge 413B of the thermal output media 413.

In yet a second alternate structure to the $4^{th}$ embodiment, a mechanical arrangement the thermal heads 411*a* and 411*b* are controlled by a stepper motor (not shown), then thermal head 411*b* is located ½ the distance of the donor medium 414*a* which is mechanically and fixedly connected in-between the two roller mechanisms, for example spools 416*a* and 417*a,* and is adapted to move in the direction of the printing process. The thermal printing head 411*a* is positioned at the leading edge 413*a* of the thermal output media 413. Both heads 411*a* and 411*b* travel during the same time interval in unison in a reverse direction with the head 411*b* beginning at the trailing edge 413*b* of the thermal output media 413. The head 411*a* thermally prints ½ or midway across the thermal output media 413 while the 411*b* thermally prints ½ or midway across the thermal output media 413 in a sequencing of steps for operation of the printing mechanism 300. As thermal head 411*a* completes 100% of its' printing process, thermal head 411*b* will have printed 50% of its' printing process and so on. Therefore, a printing time efficiency equal to or greater than 50% per two thermal colors is achieved since the print head 411*a* completes 50% of its operational task during the same time interval the head 411*b* is operational.

In FIG. 4, two spools of thermal donor media 414*a* and 414*b* are depicted wherein spool 414A is shown to contain yellow media 415 and cyan media 419. The donor media 414*b* is shown to contain magenta media 418 and black media 420. All media described are thermally activated to print.

The two donor media 414*a* and 414*b* can be increased by one of ordinary skill to four sets of donor media with one of each of four heads adjacent and underneath each set of donor media wherein, for example, spool 414*a* is 100% yellow media; spool 414*b* is 100% magenta media; and by linear extrapolation a spool 414*c* (not shown) is 100% cyan media and interposed between the spools 414*a* and 414*b;* and 414*c* (not shown) is 100% black media and also interposed between the spools 414*a* and 414*b*. The operation of this arrangement results in a time savings of approximately 63% for the entire printing process with an additional increase in efficiency associated with the time savings for head mechanical alignment and positioning of the multiples heads simultaneously and the time savings associated with multiple thermal output media projection times, thus significantly reducing total printing time.

As thermal heads have become cheaper and smaller and are now more widely used in consumer applications, the third embodiment is economically viable for large scale production. It should be noted that it is well known to those in this art that with certain known types of thermal output media, the density of printing elements or pixels is increased, sometimes by a factor of 2 to print four separate pixels in an equivalent 300 dpi density due to the color science of printing one color before another and vice versa in different areas of the same output media.

The invention has been described in detail with particular reference to a first preferred embodiment thereof, but it will be understood that variations and modifications can be effected within the spirit and scope of the novel invention and subject to the doctrine of equivalents.

PARTS LIST

10 prior art printer mechanism
11 thermal print head
11*a* first thermal print head
11*b* second thermal print head
12 thermal heating elements
13 hard copy output
13*a* leading edge of hard copy output
13*b* trailing edge of hard copy output
14 donor material
15 yellow donor media
16 first donor media spool
17 second donor media spool
18 donor media magenta
100 first thermal printing mechanism
111 thermal print head
112 heating elements
113 thermally sensitive output media
113*a* leading edge of thermally sensitive output media
113*b* trailing edge of thermally sensitive output media
114 donor media
115 yellow media section
116 first donor media spool
117 second donor media spool
118 customer retrieval shelf
119 cyan media section
120 black media section
121 universal stepping motor
181 magenta media section
200 first alternate printing mechanism
218 customer retrieval shelf
222 universal stepping motor
312*a* first heating element set
312*b* second heating element set
313 thermal output media
313*a* leading edge of thermal output media
313*b* trailing edge of thermal output media
314 spooled donor media
315 yellow media section
316 single donor media spool
317 uptake media spool
318 thermally sensitive donor media with magenta color donor area
319 thermally sensitive donor media with cyan color donor area
320 thermally sensitive donor media with black color donor area
300 alternate third thermal printing mechanism
411*a* first thermal print head
411*b* second thermal print head
412*a* heating elements of thermal head 411*a*
412*b* heating elements of thermal head 411*b*
413 thermally sensitive hard copy output media
413*a* leading edge
413*b* trailing edge
414*a* spooled donor media
414*b* spooled donor media
415 thermally sensitive donor media with yellow color donor area
416 first donor media spool
417 second donor media spool
416*a* first donor media output spool
416*b* second donor media output spool
417*a* first donor media input spool
417*b* second donor media input spool
418 thermally sensitive donor media with magenta color donor area
419 thermally sensitive donor media with cyan color donor area
420 thermally sensitive donor media black color donor area

What is claimed is:

1. A method of operating a thermal printer to produce at least one output sheet with a multiple color image thereon, the method comprising:

providing in a printing zone a donor sheet material having a first substance having a first distinct colorant and a second substance having a second distinct colorant, the donor sheet material being supported between a single supply roll and a single take-up roll and the donor sheet extending for a full width dimension of the output sheet;

providing first and second printing heads, the first and second printing heads having recording elements adapted to engage the donor sheet material to selectively transfer colorant as an image to the output sheet; and operating the first and second printing heads to provide linear movement to each of said first and second printing heads while in engagement with the donor sheet material so that each printing head transfers colorant to said output sheet to transfer a multiple color image to the output sheet without removing the output sheet to a position remote from the printing zone until after the multiple color image is transferred thereto.

2. A method of operating a thermal printer to produce at least one output sheet with a multiple color image thereon, the method comprising:

providing in a printing zone a donor sheet material having a first substance having a first distinct colorant and a second substance having a second distinct colorant, the donor sheet material being supported between a single supply roll and a single take-up roll;

providing first and second printing heads, the first and second printing heads having recording elements adapted to engage the donor sheet material to selectively transfer colorant as an image to the output sheet;

operating the first and second printing heads to provide linear movement to each of said first and second printing heads while in engagement with the donor sheet material so that each printing head transfers colorant to said output sheet to transfer a multiple color image to the output sheet without removing the output sheet to a position remote from the printing zone until after the multiple color image is transferred thereto; and wherein linear movement is provided to said second printing head while in engagement with the donor sheet material so that the second printing head transfers colorant to said output sheet during return movement of said first printing head to a position by an edge of said output sheet.

3. The method according to claim 2 and wherein during said linear movement of said first printing head a first colorant only is transferred to said output sheet and during said linear movement of said second printing head a second colorant only and of a different coloration from said first colorant is transferred to said output sheet and wherein said output sheet is moved after said first linear movement to position the output sheet to receive said second colorant for printing by said second printing head.

4. A method of operating a thermal printer to produce at least one output sheet with a multiple color image thereon, the method comprising:

providing in a printing zone a donor sheet material having a first substance having a first distinct colorant and a second substance having a second distinct colorant, the donor sheet material being supported between a single supply roll and a single take-up roll;

providing first and second printing heads, the first and second printing heads having recording elements adapted to engage the donor sheet material to selectively transfer colorant as an image to the output sheet;

operating the first and second printing heads to provide linear movement to each of said first and second printing heads while in engagement with the donor sheet material so that each printing head transfers colorant to said output sheet to transfer a multiple color image to the output sheet without removing the output sheet to a position remote from the printing zone until after the multiple color image is transferred thereto; and wherein the first and second printing heads operate to transfer colorant of the same color to the output sheet.

5. A method of operating a thermal printer to produce at least one output sheet with a multiple color image thereon, the method comprising:

providing in a printing zone a donor sheet material having a first substance having a first distinct colorant and a second substance having a second distinct colorant, the donor sheet material being supported between a single supply roll and a single take-up roll;

providing first and second printing heads, the first and second printing heads having recording elements adapted to engage the donor sheet material to selectively transfer colorant as an image to the output sheet;

operating the first and second printing heads to provide linear movement to each of said first and second printing heads while in engagement with the donor sheet material so that each printing head transfers colorant to said output sheet to transfer a multiple color image to the output sheet without removing the output sheet to a position remote from the printing zone until after the multiple color image is transferred thereto; and wherein during said linear movement of said first printing head a first colorant only is transferred to said output sheet and during said linear movement of said second printing head a second colorant only and of a different coloration from said first colorant is transferred to said output sheet and wherein said output sheet is moved after said linear movement of said first printing head to position the output sheet to receive said second colorant for printing by said second printing head and further wherein said linear movement of said first printing head is in a direction opposite to a direction of said linear movement of said second printing head.

6. A method of operating a thermal printer to produce at least one output sheet with a multiple color image thereon, the method comprising: providing in a printing zone a first donor sheet material having a first substance having a first distinct colorant and a second substance having a second distinct colorant the first donor sheet material being supported between a first set of a single supply roll and a single take-up roll and the first colorant having different coloration from the second colorant; providing in the printing zone a second donor sheet material having a third substance having a third distinct colorant and a fourth substance having a fourth distinct colorant the second donor sheet material being supported between a second set of a single supply roll and a single take-up roll and the third colorant having different coloration from the fourth colorant; providing first and second printing heads, the first and second printing heads having recording elements adapted to engage respectively the first and second donor sheet materials to transfer colorants from the respective donor sheet materials as an image to the output sheet; operating the first and second printing heads to provide linear movement to each of said first and second printing heads while each is in engagement with a respective donor sheet material so that each printing head operates to transfer at least two colorants to said output sheet to transfer a multiple color image of at least three colors to the output sheet without removing the output sheet to a position remote from the printing zone until after the multiple color image is transferred thereto.

7. The method according to claim 6 and wherein each printing head at any one time operates to transfer only one colorant.

* * * * *